US009194680B2

(12) United States Patent
Padgett et al.

(10) Patent No.: US 9,194,680 B2
(45) Date of Patent: Nov. 24, 2015

(54) POLYMER-BASED MACHINE GUN BELT LINKS AND CARTRIDGE CASINGS AND MANUFACTURING METHOD

(71) Applicant: PCP Tactical, LLC, Vero Beach, FL (US)

(72) Inventors: Charles Padgett, Vero Beach, FL (US); Robert Lanse Padgett, Vero Beach, FL (US)

(73) Assignee: PCP TACTICAL, LLC, Vero Beach, FL (US)

( * ) Notice: Subject to any disclaimer, the term of this patent is extended or adjusted under 35 U.S.C. 154(b) by 0 days.

(21) Appl. No.: 14/460,877

(22) Filed: Aug. 15, 2014

(65) Prior Publication Data

US 2015/0285605 A1 Oct. 8, 2015

Related U.S. Application Data

(60) Division of application No. 13/836,192, filed on Mar. 15, 2013, now Pat. No. 8,807,008, which is a continuation-in-part of application No. 13/350,607, filed on Jan. 13, 2012, now Pat. No. 8,443,730.

(Continued)

(51) Int. Cl.

| | |
|---|---|
| ***F42B 39/08*** | (2006.01) |
| ***F42B 5/30*** | (2006.01) |
| ***F42B 5/307*** | (2006.01) |

(52) U.S. Cl.

CPC ..... *F42B 39/087* (2013.01)

(58) Field of Classification Search

CPC ..... F42B 5/00; F42B 5/02; F42B 5/18; F42B 5/181; F42B 5/26; F42B 5/28; F42B 5/30; F42B 5/307; F42B 5/313; F42B 39/08; F42B 39/087; F42B 39/085; F42B 5/192; F42B 5/188; F41A 9/04; F41A 9/29–9/34; F41A 9/37; F41A 9/54; F41A 9/60; F42C 19/085

USPC ..... 89/35.02

See application file for complete search history.

(56) References Cited

U.S. PATENT DOCUMENTS

| | | | |
|---|---|---|---|
| 692,819 | A | 2/1902 | Bissel |
| 827,600 | A | 7/1906 | Bailey |

(Continued)

FOREIGN PATENT DOCUMENTS

| | | |
|---|---|---|
| DE | 11 13 880 | 9/1961 |
| DE | 2205619 A1 | 8/1972 |

(Continued)

OTHER PUBLICATIONS

Chung, Jerry S., "Alternative Cartridge Case Material and Design", Armament Research, Development and Engineering Center Technical Report ARAEW-TR-05007, May 2005.

(Continued)

*Primary Examiner* — Bret Hayes
*Assistant Examiner* — Derrick Morgan
(74) *Attorney, Agent, or Firm* — Troutman Sanders LLP

(57) ABSTRACT

An example of a high strength polymer-based linked cartridge can have a casing inclosing a volume with a mouth and a neck extending away from the mouth. Next, there is a shoulder extending below the neck and a body extending below the shoulder. The body has a finger disposed on a first side of the body, the finger having a length and at least two fingers disposed on a second side of the body. The body also has a pawl catch disposed on a third side of the body. The at least two fingers can be spaced from each other a distance approximately equal to the length, and they can be configured to engage a finger disposed on a second cartridge.

3 Claims, 14 Drawing Sheets

Related U.S. Application Data

(60) Provisional application No. 61/433,170, filed on Jan. 14, 2011, provisional application No. 61/509,337, filed on Jul. 19, 2011, provisional application No. 61/532,044, filed on Sep. 7, 2011, provisional application No. 61/555,684, filed on Nov. 4, 2011.

(56) References Cited

U.S. PATENT DOCUMENTS 1,038,078 A * 9/1912 Bjorgum ..... 89/35.01
1,118,888 A 11/1914 Butler
1,233,071 A 7/1917 Lindquist
2,022,685 A 12/1935 Moore
2,263,941 A 11/1941 George
2,294,822 A 9/1942 George
2,366,887 A 1/1945 Warren
2,379,510 A 7/1945 Ewart
2,395,460 A 2/1946 Carten
2,401,050 A * 5/1946 Cooper et al. ..... 89/35.02
2,402,068 A 6/1946 Meador
2,426,448 A * 8/1947 Goldfisher ..... 89/35.02
2,435,590 A 2/1948 Holroyd
2,455,080 A 11/1948 Miller et al.
2,481,726 A 9/1949 Muschamp
2,648,258 A 8/1953 Simpson
2,654,319 A 10/1953 Roske
2,862,446 A 8/1955 Ringdal
2,915,947 A 12/1959 Heeley
2,918,868 A 12/1959 Ringdal
2,995,090 A 8/1961 Daubenspeck
3,078,765 A 2/1963 Falcone et al.
3,099,958 A 8/1963 Daubenspeck et al.
3,123,003 A 3/1964 Lange, Jr. et al.
3,144,827 A 8/1964 Boutwell et al.
3,253,512 A * 5/1966 Schallehn ..... 89/35.02
3,333,506 A 8/1967 Henshaw et al.
3,336,871 A 8/1967 Quinlan
3,485,170 A 12/1969 Scanlon
3,609,904 A 10/1971 Scanlon
3,650,176 A 3/1972 Lindner
3,659,528 A 5/1972 Santala
3,696,705 A * 10/1972 Hrabovsky ..... 89/35.02
3,706,260 A 12/1972 Rausing
3,712,172 A * 1/1973 Wiese ..... 89/17
3,726,218 A 4/1973 Austin, Jr.
3,745,924 A 7/1973 Scanlon
3,749,020 A 7/1973 Weyhmuller
3,749,023 A 7/1973 Kawaguchi et al.
3,785,293 A 1/1974 Barr
3,797,396 A 3/1974 Reed
3,808,974 A 5/1974 Herter
3,818,834 A 6/1974 Baumgartener
3,830,157 A 8/1974 Donnard et al.
3,842,739 A 10/1974 Scanlon et al.
3,855,686 A 12/1974 Snyder
3,861,308 A * 1/1975 Grandy ..... 102/430
3,874,294 A 4/1975 Hale
3,913,445 A 10/1975 Grandy
3,935,816 A 2/1976 Boquette, Jr.
3,955,506 A 5/1976 Luther et al.
3,977,326 A 8/1976 Anderson et al.
3,983,990 A * 10/1976 Gardy et al. ..... 198/803.14
3,990,366 A 11/1976 Scanlon
3,999,482 A 12/1976 Bilek
4,004,491 A 1/1977 Seeling
4,004,492 A * 1/1977 Savioli ..... 89/35.02
4,147,107 A 4/1979 Ringdal
4,165,943 A 8/1979 Beach et al.
4,173,186 A 11/1979 Dunham
4,187,271 A 2/1980 Rolston et al.
4,290,339 A * 9/1981 Skahill ..... 89/33.25
4,359,925 A 11/1982 Abet et al.
4,469,027 A 9/1984 Burns et al.
4,474,102 A 10/1984 Tassie
4,498,396 A 2/1985 Berube
4,546,704 A 10/1985 Ballreich et al.
4,553,479 A 11/1985 Willoughby
4,562,768 A 1/1986 Weinfurth et al.
H61 H 5/1986 Yuhash et al.
4,620,485 A 11/1986 Bertiller
4,683,170 A 7/1987 Tse et al.
4,697,523 A 10/1987 Saxby
4,719,859 A 1/1988 Ballreich et al.
4,726,296 A 2/1988 Leshner et al.
4,738,202 A 4/1988 Hebert
4,790,231 A 12/1988 Stoner
4,803,926 A 2/1989 Barton et al.
4,809,612 A 3/1989 Ballreich et al.
4,841,837 A 6/1989 Novet
4,867,065 A 9/1989 Kaltmann et al.
5,033,386 A 7/1991 Vatsvog
5,063,853 A 11/1991 Bilgeri
5,151,555 A 9/1992 Vatsvog
5,165,040 A 11/1992 Andersson et al.
5,233,928 A 8/1993 Ducros et al.
5,237,930 A 8/1993 Belanger et al.
5,259,288 A 11/1993 Vatsvog
5,259,319 A 11/1993 Dravecky et al.
5,277,119 A 1/1994 Ricco
5,359,937 A 11/1994 Dittrich
5,368,526 A * 11/1994 Hynes ..... 474/207
5,460,096 A 10/1995 Kothe
5,492,063 A 2/1996 Dittrich
5,507,232 A 4/1996 Valdez
5,563,365 A 10/1996 Dineen et al.
5,616,642 A 4/1997 West et al.
5,653,563 A 8/1997 Ernst et al.
5,677,505 A 10/1997 Dittrich
5,703,322 A 12/1997 Tidman
5,708,231 A 1/1998 Koon
5,770,815 A 6/1998 Watson
5,822,904 A 10/1998 Beal
5,893,959 A 4/1999 Muellich
5,969,288 A 10/1999 Baud
6,048,379 A 4/2000 Bray et al.
6,074,454 A 6/2000 Abrams et al.
6,101,949 A 8/2000 Maucourt et al.
6,131,519 A 10/2000 Thiesen et al.
6,257,149 B1 7/2001 Cesaroni
6,283,035 B1 9/2001 Olson et al.
6,367,386 B1 4/2002 Brede et al.
6,430,861 B1 * 8/2002 Ayers et al. ..... 42/84
6,439,123 B1 8/2002 Dionne et al.
6,523,476 B1 2/2003 Riess et al.
6,539,874 B2 4/2003 Weise
6,584,909 B2 7/2003 Brede et al.
6,598,536 B2 7/2003 Burri
6,600,002 B2 7/2003 Sanderson et al.
6,748,870 B2 6/2004 Heidenreich et al.
6,752,084 B1 6/2004 Husseini et al.
6,832,557 B2 12/2004 Torsten
6,845,716 B2 1/2005 Husseini et al.
6,862,993 B1 3/2005 Cudazzo
6,886,467 B1 5/2005 Haeselich
7,032,492 B2 4/2006 Meshirer
7,059,234 B2 6/2006 Husseini
7,165,496 B2 1/2007 Reynolds
7,204,191 B2 4/2007 Wiley et al.
7,213,519 B2 5/2007 Wiley et al.
7,231,519 B2 6/2007 Joseph et al.
7,406,908 B1 8/2008 Goon et al.
7,441,504 B2 10/2008 Husseini et al.
7,610,858 B2 11/2009 Chung
7,938,067 B2 5/2011 Dindl
8,087,359 B2 1/2012 Sauvestre
8,146,281 B2 4/2012 Zimmerman
8,151,683 B2 * 4/2012 Dick et al. ..... 89/33.14
8,240,252 B2 8/2012 Maljkovic et al.
8,342,072 B2 * 1/2013 Abbott ..... 89/33.2
8,443,730 B2 5/2013 Padgett
8,807,008 B2 * 8/2014 Padgett et al. ..... 89/35.02
2003/0019385 A1 1/2003 Leasure et al.
2003/0167952 A1 9/2003 Heidenreich et al.
2003/0172775 A1 9/2003 Amick

(56) References Cited

U.S. PATENT DOCUMENTS

| | | | | |
|---|---|---|---|---|
| 2004/0011237 | A1 | 1/2004 | Khvichia et al. | |
| 2004/0237827 | A1 | 12/2004 | Smalley, Jr. et al. | |
| 2005/0188879 | A1 | 9/2005 | Wiley et al. | |
| 2005/0188883 | A1 | 9/2005 | Husseini et al. | |
| 2005/0257711 | A1 | 11/2005 | Husseini et al. | |
| 2006/0011087 | A1 | 1/2006 | Husseini et al. | |
| 2006/0102041 | A1 | 5/2006 | Wiley et al. | |
| 2006/0207464 | A1 | 9/2006 | Maljkovic et al. | |
| 2007/0214992 | A1 | 9/2007 | Dittrich | |
| 2007/0261587 | A1 | 11/2007 | Chung | |
| 2008/0245219 | A1 | 10/2008 | Moucheboeuf et al. | |
| 2009/0044717 | A1 | 2/2009 | Husseini et al. | |
| 2009/0151710 | A1* | 6/2009 | Zimmerman | 124/48 |
| 2009/0249947 | A1 | 10/2009 | Coiffet et al. | |
| 2010/0056687 | A1 | 3/2010 | Diakoumakos et al. | |
| 2010/0275804 | A1 | 11/2010 | Trivette | |
| 2010/0282112 | A1 | 11/2010 | Battaglia | |
| 2010/0305261 | A1 | 12/2010 | Maljkovic et al. | |
| 2011/0000391 | A1 | 1/2011 | Heitmann | |
| 2011/0179965 | A1 | 7/2011 | Mason | |
| 2011/0214583 | A1 | 9/2011 | Dutch | |
| 2011/0252999 | A1 | 10/2011 | Carlson et al. | |
| 2011/0290143 | A1 | 12/2011 | Heitmann et al. | |
| 2012/0024183 | A1 | 2/2012 | Klein | |
| 2012/0060716 | A1 | 3/2012 | Davies et al. | |
| 2012/0111219 | A1 | 5/2012 | Burrow | |
| 2012/0118132 | A1* | 5/2012 | Coker et al. | 89/13.05 |
| 2012/0144712 | A1 | 6/2012 | Rostocil | |
| 2012/0174813 | A1 | 7/2012 | Battaglia | |
| 2012/0180687 | A1 | 7/2012 | Padgett | |
| 2012/0180688 | A1 | 7/2012 | Padgett | |
| 2012/0318128 | A1* | 12/2012 | Gotie | 89/33.14 |
| 2013/0014664 | A1 | 1/2013 | Padgett | |
| 2013/0025490 | A1 | 1/2013 | Burczynski | |
| 2013/0186294 | A1 | 7/2013 | Davies et al. | |
| 2014/0060372 | A1 | 3/2014 | Padgett | |
| 2014/0069290 | A1* | 3/2014 | Padgett et al. | 102/466 |

FOREIGN PATENT DOCUMENTS

| | | | |
|---|---|---|---|
| DE | 3344369 | A1 | 6/1985 |
| EP | 0096617 | | 12/1983 |
| EP | 0444545 | A1 | 9/1991 |
| EP | 0526317 | A1 | 2/1993 |
| FR | 1081764 | A | 12/1954 |
| GB | 2092274 | | 8/1982 |
| WO | WO 88/09476 | A1 | 12/1988 |
| WO | WO 95/13516 | A1 | 5/1995 |
| WO | 03/036222 | | 5/2003 |
| WO | 2005/022072 | | 3/2005 |
| WO | WO 2006/094987 | | 9/2006 |
| WO | WO 2010/129781 | | 11/2010 |
| WO | WO 2012/047615 | A1 | 4/2012 |
| WO | WO 2012/097317 | A2 | 7/2012 |
| WO | WO 2012/097317 | A3 | 7/2012 |
| WO | WO 2012/097320 | A1 | 7/2012 |

OTHER PUBLICATIONS

File history of U.S. Appl. No. 61/456,664, which corresponds to US 2012/0111219.

International Search Report, dated Aug. 24, 2012, which issued during the prosecution of International Patent Application No. PCT/US2012/021345.

International Search Report, dated May 23, 2012, which issued during the prosecution of International Patent Application No. PCT/US2012/021350.

European Search Report dated May 15, 2014.

European Search Report dated Jul. 28, 2014, which issued during prosecution of European Application No. 14161657.3, which corresponds to the present application.

* cited by examiner

FIG. 10
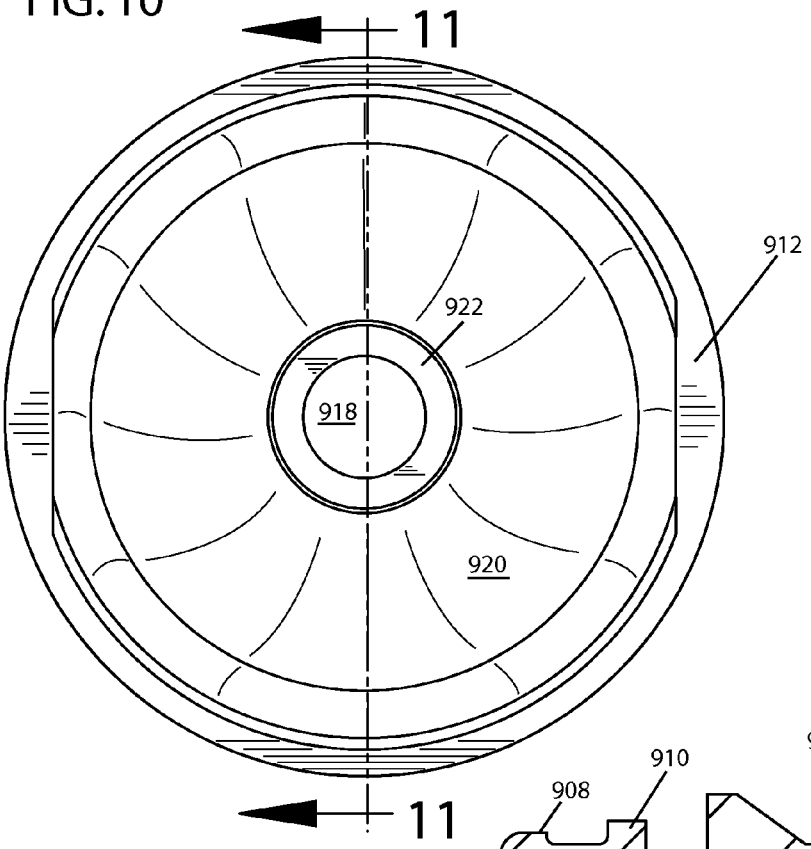
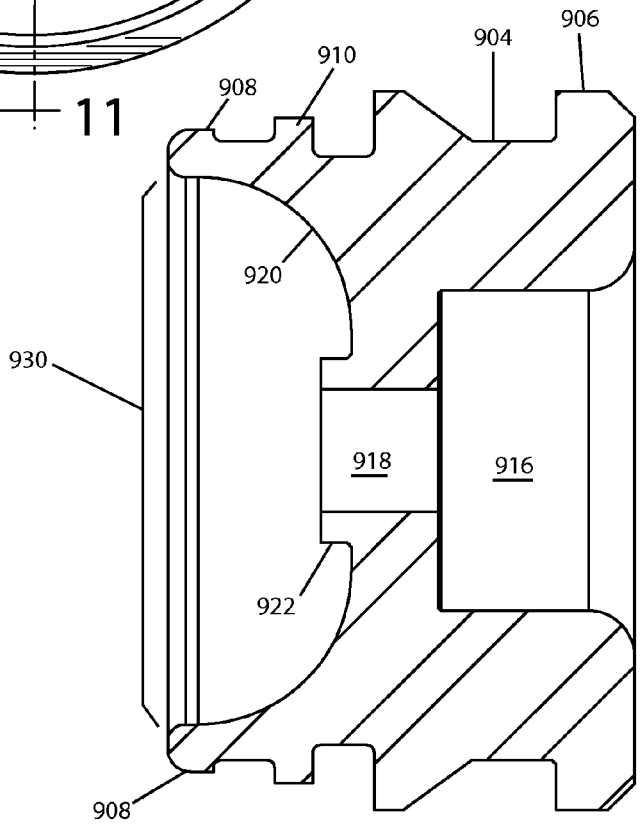
FIG. 11

POLYMER-BASED MACHINE GUN BELT LINKS AND CARTRIDGE CASINGS AND MANUFACTURING METHOD

CROSS-REFERENCE TO RELATED APPLICATIONS

This application is a Divisional of U.S. application Ser. No. 13/836,192 filed Mar. 15, 2013, which is a Continuation-In-Part of U.S. application Ser. No. 13/350,607, filed Jan. 13, 2012, now U.S. Pat. No. 8,443,730, which claims priority to U.S. Provisional Application Ser. No. 61/433,170 filed Jan. 14, 2011, U.S. Provisional Application Ser. No. 61/509,337 filed Jul. 19, 2011, U.S. Provisional Application Ser. No. 61/532,044 filed Sep. 7, 2011, and U.S. Provisional Application Ser. No. 61/555,684 filed Nov. 4, 2011. All of the above applications are incorporated herein by reference.

TECHNICAL FIELD

The present subject matter relates to machine gun ammunition, specifically the links forming the belts and cartridge cases with integral links.

BACKGROUND

Belt fed automatic firearms, a.k.a. "machine guns" have been in the military arsenal for over 100 years. For sheer volume of ammunition, a belt fed weapon system is usually the best option. Ammunition belts consist of a long string of cartridges fastened together with pieces of canvas or, more often, attached by small metal links. Guns that use this sort of ammunition typically have a feed mechanism driven by the recoil motion of the bolt.

FIGS. 1A-1D illustrate an example of a belt feeding system 20 for a machine gun 10. FIGS. 1A and 1B illustrate the machine gun 10 with a bolt 1 cocked back, FIGS. 1C and 1D illustrate the system as it is loading a cartridge 14 into the chamber. FIGS. 1A and 1C are top plan views, with a belt of cartridges 12 being fed from left to right. FIGS. 1B and 1D are side profile views and for FIGS. 1A-1D, the cartridges 14 and belt links 3 are being ejected out of the page.

The machine gun 10 has a bolt 1, and in this example, has a small cam roller 5 disposed on top. As the bolt 1 moves, the cam roller 5 slides back and forth in a long, grooved feed cam piece 2. When the cam roller 5 slides forward, it pushes the feed cam 2 to the right (as illustrated) against a return spring 6. When the cam roller 5 slides backward, the spring 6 pushes the feed cam 2 back to the left. A feed cam lever 7 is attached to a spring-loaded pawl 8 having a curved gripper (not illustrated) that rests on top of the ammunition belt 12. As the cam 2 and the lever 7 move, the pawl 8 moves out, grabs onto a cartridge 14 and pulls the belt 12 through the gun 10. When the bolt 1 moves forward, it pushes the next cartridge 14 into the chamber 16.

The feed system 20 drives the ammunition belt 12 through cartridge guides 9 just above the breech. As the bolt 1 slides forward, the top of it pushes on the next cartridge 14 in line. This drives the cartridge 14 out of the belt 12, against the chambering ramp 11. The chambering ramp forces the cartridge 14 down in front of the bolt 1. The bolt 1 has a small extractor 15, which grips a base of the cartridge 14 when the cartridge 14 slides into place. As the cartridge 14 slides in front of the bolt 1, it depresses the spring-loaded ejector 18.

When a firing pin 19 hits a primer, the powder inside the cartridge 14 ignites and propels the bullet down the barrel 4, the explosive force drives the operating rod 17 and attached bolt 1 backward. When the cartridge shell clears the chamber wall, the ejector 18 springs forward, popping the shell out of the gun through an ejection port. This system lets you fire continuously without reloading.

In the example of the system 20 above, the ammunition must be linked in order to feed correctly. These links 3 add to the overall weight a soldier, or her vehicle, has to bear when in the field. The links 30, 32, 34, 36, as illustrated in FIGS. 2A-2D, are currently made of metal, typically nickel. FIG. 2A illustrates the current U.S. military M27 link for 5.56 mm ammunition. The M27 link is a reduced size of the M13 link for 7.62 mm ammunition. A portion of the link fits into the extractor groove on the cartridge case. The U.S. Navy uses the link with the M63 Stoner Machine Gun. The U.S. Army uses the link with the M249 Machine Gun.

A typical link is two sided, typically a two piece side and a one piece side. A single cartridge is typically inserted into each of the sides of the link. The cartridge is secured into the link by crimping the link closed onto the cartridge. This is typically not done by the manufacturer of the cartridges, but manually in the field in single or 10 round groups. This is a very time consuming process. When the cartridge is forced out of the link as the bolt moves forward, the metal pieces are spread to allow the cartridge to enter the chamber. The link is then expelled from the same ejection port as the spent cartridge.

A goal of the present invention is to form lighter weight links and to pre-link the cartridges during manufacturing.

SUMMARY

The teachings herein alleviate one or more of the above noted problems with the strength and formation of polymer based cartridges.

An example of a polymer-based machine gun link can include a first side having a finger to hold a cartridge and a second side, opposite the first side, having at least two fingers to hold a second cartridge. A stem can join the first side and the second side the two fingers are smaller than the finger and spaced along the stem so that the finger fits between the two fingers. All of the finger, the two fingers, and the stem are made from polymer.

Another example of a polymer-based machine gun link can further include a top section and a bottom section opposite the top section. The top and bottom sections can be made from polymer and are adhered to each other. In a further example, the adhesion between the top and bottom sections is incomplete. The polymer-based machine gun link can have a section wherein the section is made from polymer and is adhered to at least one of the cartridge and the second cartridge.

A yet further example of a high strength polymer-based linked cartridge casing inclosing a volume has a first end having a mouth and a neck extending away from the mouth. Next, there is a shoulder extending below the neck and away from the first end and a body extending below the shoulder. The body has a finger disposed on a first side of the body, the finger having a length and at least two fingers disposed on a second side of the body. The body also has a pawl catch disposed on a third side of the body. The at least two fingers can be spaced from each other a distance approximately equal to the length, and they can be configured to engage a finger disposed on a second cartridge.

The high strength polymer-based linked cartridge casing can also include the feature that the least two fingers rotatingly engage the second cartridge finger.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 10 is a bottom front perspective view of the insert of FIG. 9; and

FIG. 11 is a longitudinal cross-section view along line 11-11 of FIG. 10.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The present example provides a cartridge case body strong enough to withstand gas pressures that equal or surpass the strength required of brass cartridge cases under certain conditions, e.g. for both storage and handling.

Reference now is made in detail to the examples illustrated in the accompanying drawings and discussed below. The belt link 100 is made of polymer. The polymer used is lighter than brass and nickel. A glass-filled high impact polymer can be used where the glass content is between 0%-50%, preferably between 5% and 20%. In another example the glass content can be 10% and another of 15%. An example of an impact modified nylon polymer without the glass content is BASF's Capron® BU50I. Further, the polymer can be formulated to resist oil and grease, making them easier to reload. Further, they can be imparted with a small static charge to repel sand and dirt.

In one example, the prior art links 30, 32, 34, 36 can be made from polymer and used with brass cartridges. The advantage is that the polymer can be chosen to allow the cartridge to "snap" in. That is, the polymer is chosen to have a ductility and strength that no special crimping tool is necessary, the polymer can yield to fit over the casing and yield again as the cartridge is extracted. Also, as noted above, the polymer link can have a specially formulated polymer to facilitate reloading of the link.

Figure 1A:
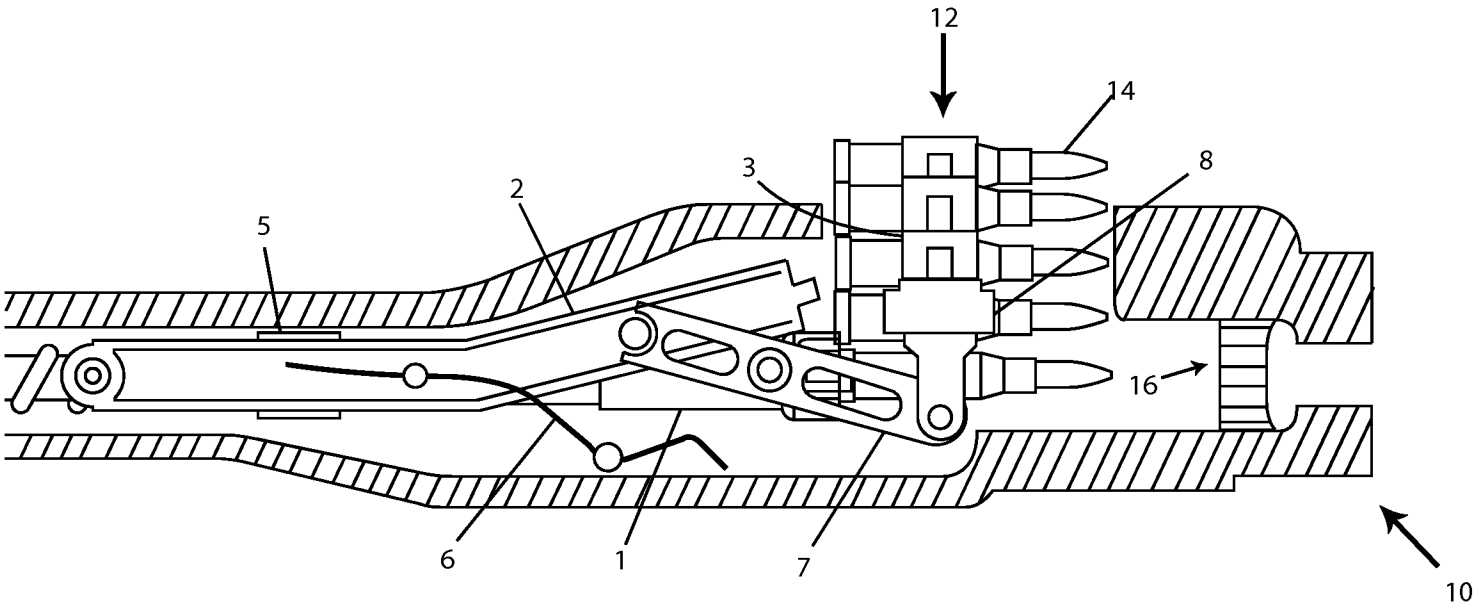
FIG. 1A is a top cross-sectional view of a conventional machine gun with the bolt back.
Figure 1B:
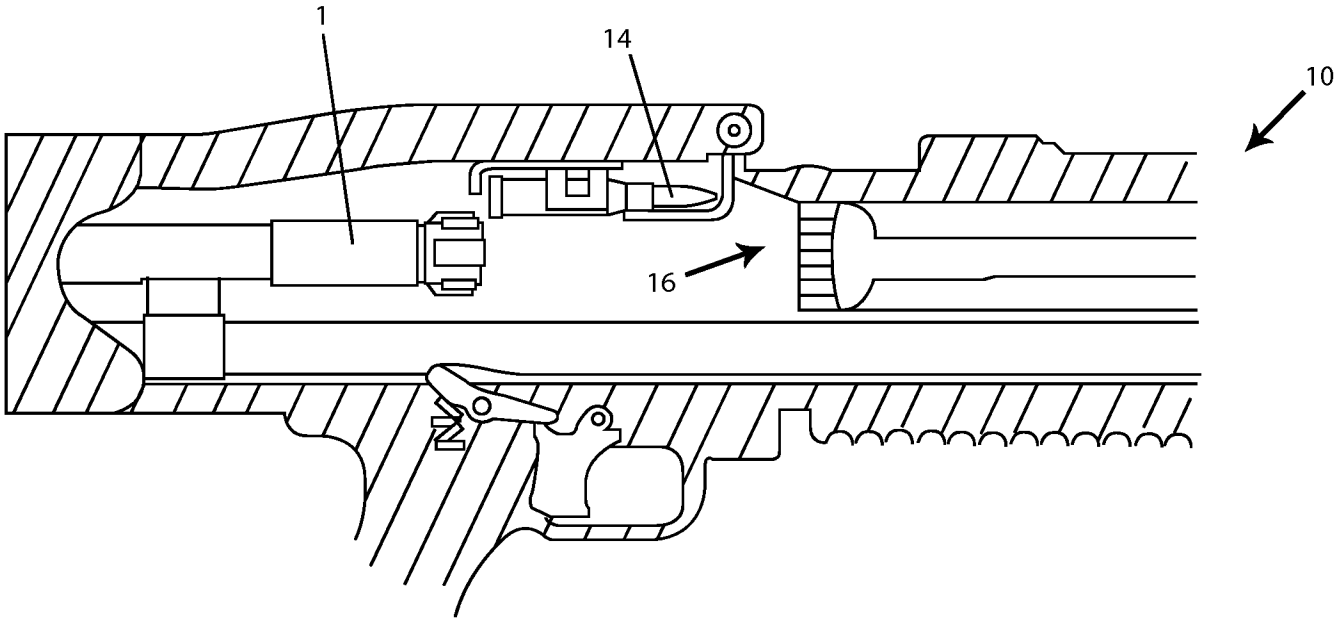
FIG. 1B is a side cross-sectional view of a conventional machine gun with the bolt back.
Figure 1C:
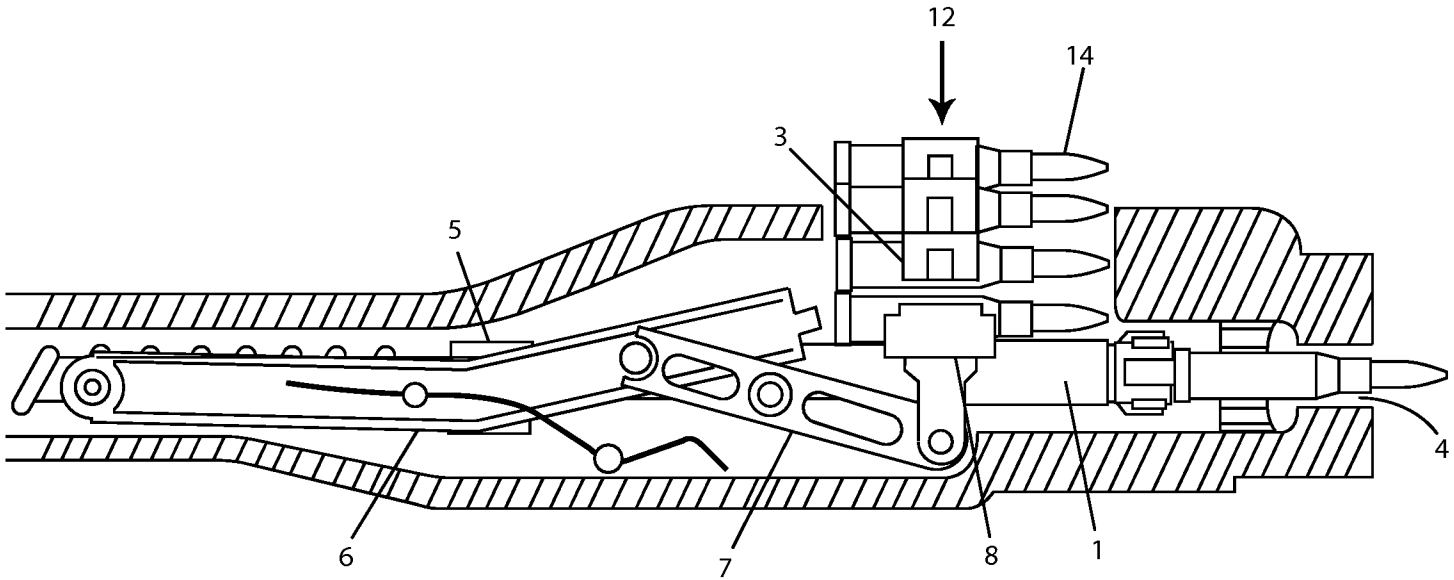
FIG. 1C is a top cross-sectional view of a conventional machine gun loading the cartridge.
Figure 1D:
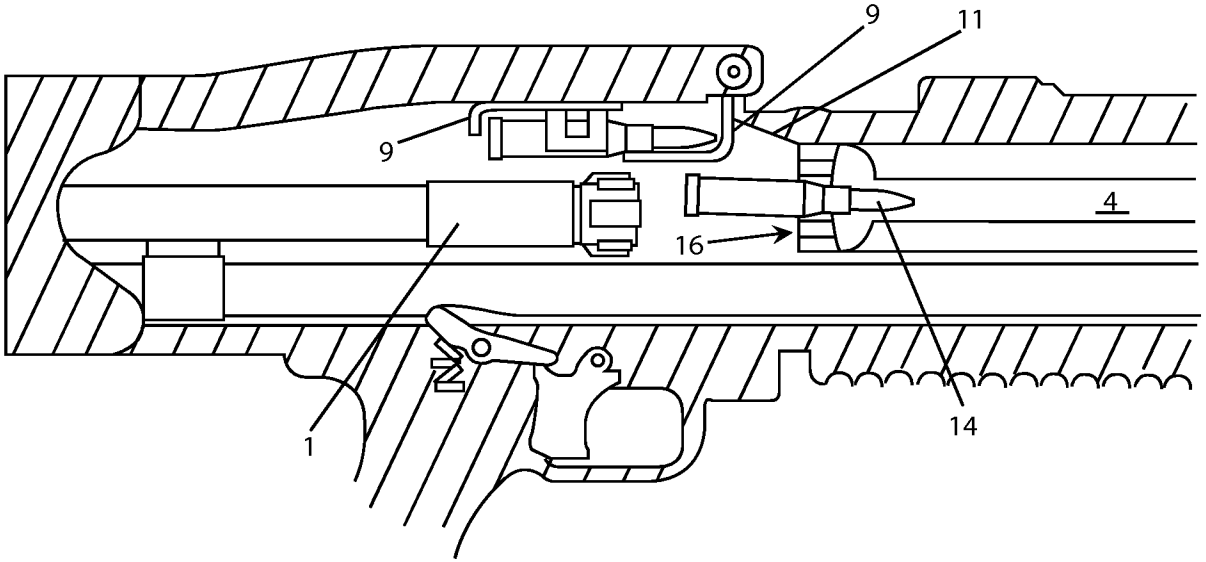
FIG. 1D is a side cross-sectional view of a conventional machine gun loading the cartridge.
Figure 2A:
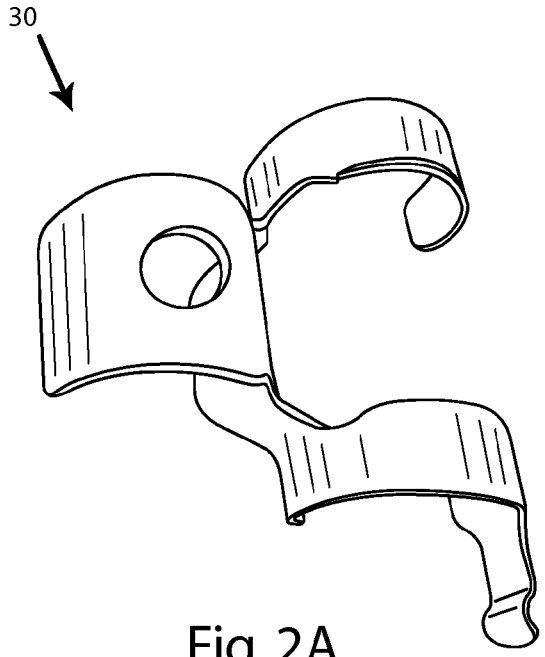
FIGS. 2A-2D are views of conventional belt links.
Figure 2B:
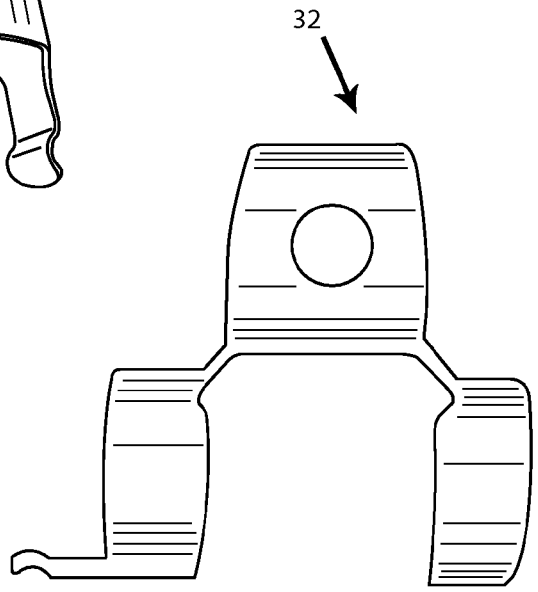
Figure 2C:
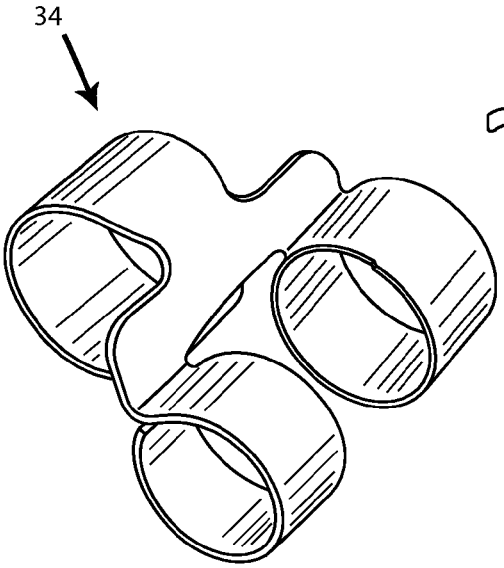
Figure 2D:
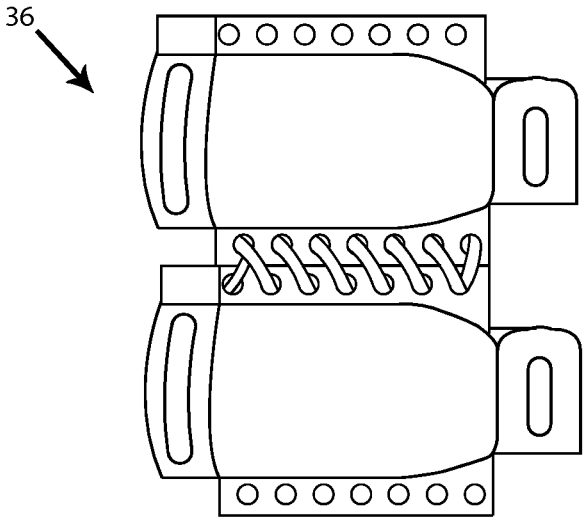
Figure 3A:
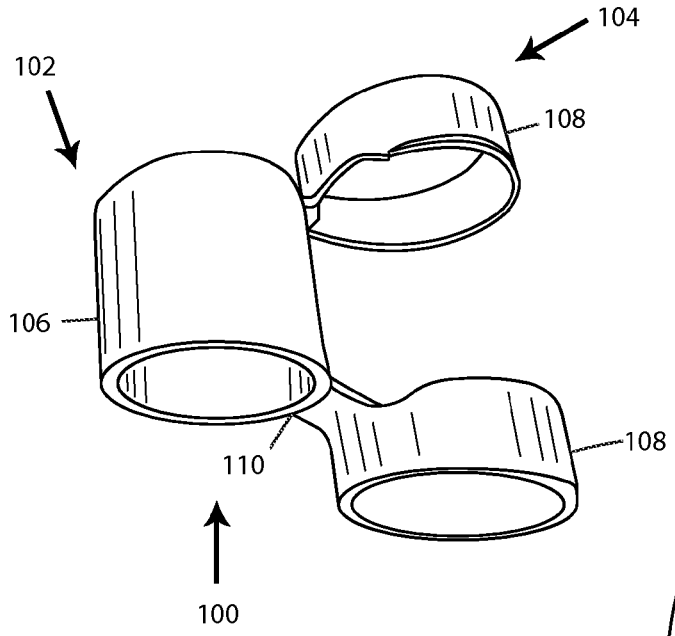
FIG. 3A is a top front isometric view of an example of a belt link according to the present invention.
Figure 3B:
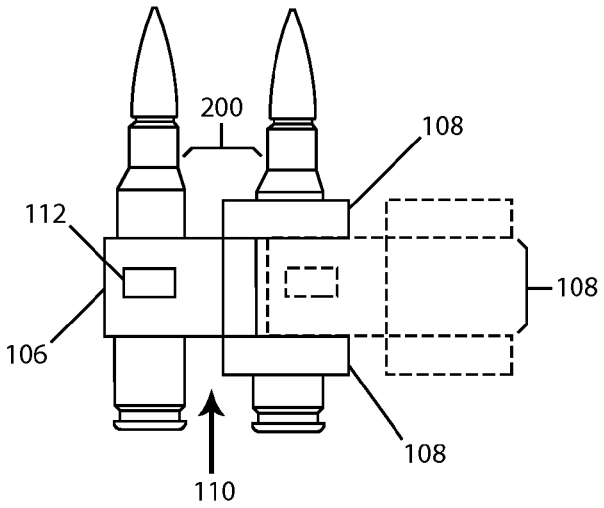
FIG. 3B is a top view of an example of the belt link joined with cartridges.
Figure 3C:
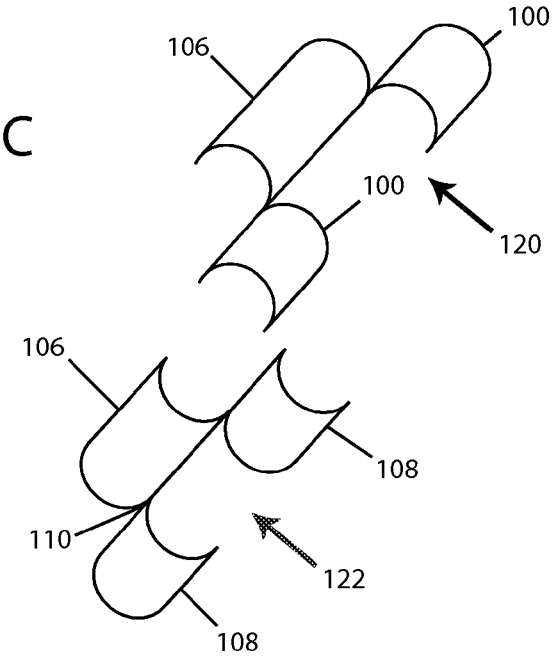
FIG. 3C is an exploded top front isometric view of the belt link.

In other examples, polymer links can be used with polymer casings for new configurations and lighter weight ammunition belts. FIGS. 3A and 3B illustrate an example of a belt link 100. The belt link 100 has a first side 102 and a second side 104. The first side 102 can have a single finger 106 to hold a cartridge 200. The second side 104 can have two fingers 108, also to hold a single cartridge 200. The two sides 102, 104 are typically joined at a stem 110. The two fingers 108 are typically smaller and spaced along the stem 110 so that the single finger 106 can fit between, as can be seen in FIG. 3B. The spacing between the two fingers 108 can be dictated by the caliber of the cartridge and the make and model of the machine gun. The single finger 106 can have pawl catch 112 to allow the belt link 100 to be pulled through the machine gun as discussed above. The pawl catch 112 can be a raised surface or a recessed surface depending on the example and the requirement of the machine gun in use.

The belt link 100 can be formed from a top section 120 and a bottom section 122. The two sections 120, 122 can be molded separately and then assembled over the cartridge. In one example, multiple bottom sections 122 are placed so the single finger 106 is between the two fingers 108 to allow for the cartridges 200 to be linked. Multiple top sections 122 are then placed over the cartridges 200 and the bottom sections 122. The top and bottom sections 120, 122 can then be can be adhered by an ultraviolet (UV) light weld process or heat cured resin, a spin weld, or an ultrasonic weld. The adhering process can be performed on an assembly line as polymer cased cartridges are being formed, allowing the belts to be manufactured on the same assembly line.

Numerous other examples can follow from the above. To increase flexibility, the stem 110 can be formed as a hinge, allowing the first and second 102, 104 sides to rotate freely in relation to the other. Further, just a top or bottom section 120, 122 can be used and adhered to a polymer cartridge. Another example can be that the adhering process joining the top and/or bottom sections 120, 122 is incomplete or weakened. In this way, the polymer link 100 can be sheared more easily when being fed through the machine gun. This can lead to a reduction in recoil, as the bolt does not have to apply as much force to free the cartridge from the belt link.

Figure 4A:
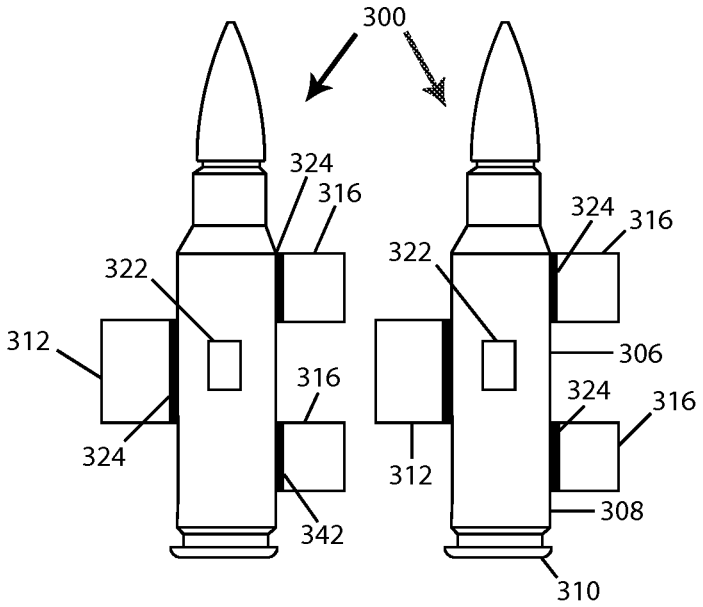
FIG. 4A illustrates a linked cartridge of an example of the present invention.

Turning now to FIG. 4A, an integrated cartridge and link 300 are illustrated. The linked cartridge 300 can be formed from polymer molding and include some of the standard features of a cartridge, including a neck 302, a shoulder 304 extending below the neck 302, and a body 306 extending below the shoulder 304. The end of the body 306 opposite the shoulder 304 can be formed with an extraction groove 308 and a rim 310. The neck 302, shoulder 304, body 306, groove 308 and rim 310 are dimensioned to the specific size as dictated by the caliber of the ammunition. The linked cartridge 300 can be formed similar to the cartridges described in U.S. patent application Ser. No. 10/350,607, (which is incorporated by reference in its entirety) to include an upper component, a lower component, and an insert, described further below.

Figure 4B:
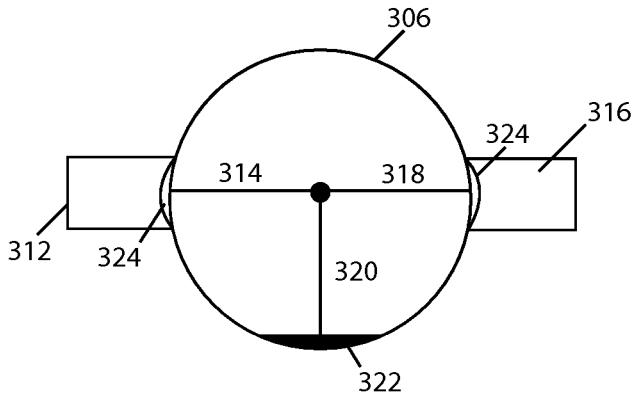
FIG. 4B illustrates an idealized cross-section of a linked cartridge.

Additionally, the linked cartridge 300 can be molded with a single finger 312 on a first radius 314 and two fingers 316 at a second radius 318. FIG. 4B illustrates an idealized cross section of the linked cartridge 300. Illustrating the body 306 as a perfect circle, the first and second radiuses 314, 318 can be 180° apart, allowing the single finger 312 and the two fingers 316 to be opposite each other. On a third radius 320, in one example 90° from both the first and second radiuses 314, 318, a pawl catch 322 can be formed in the body 306. The pawl catch 322 can be molded to engage the pawl of the machine gun to allow the linked cartridges 300 to be fed through the machine gun. Further, the pawl catch 322 is molded not to interfere with the cartridge being seated in the chamber. Note that the pawl catch 322 can be one of a raised or recessed surface.

The fingers 312, 316 can be molded to snap fit into each other. The snap fit can allow the linked cartridges 300 to rotate relative to each other or, in other examples, is rigid. The snap fit can be designed to be performed manually without the use of special tools in the field, or more preferably, snapped together when the linked cartridges 300 are being formed. In a separate example, the first and second fingers 312, 316 can be adhered together for additional strength. Another example can have the fingers 312, 316 adhered to the body 306, as described above.

Figure 5:
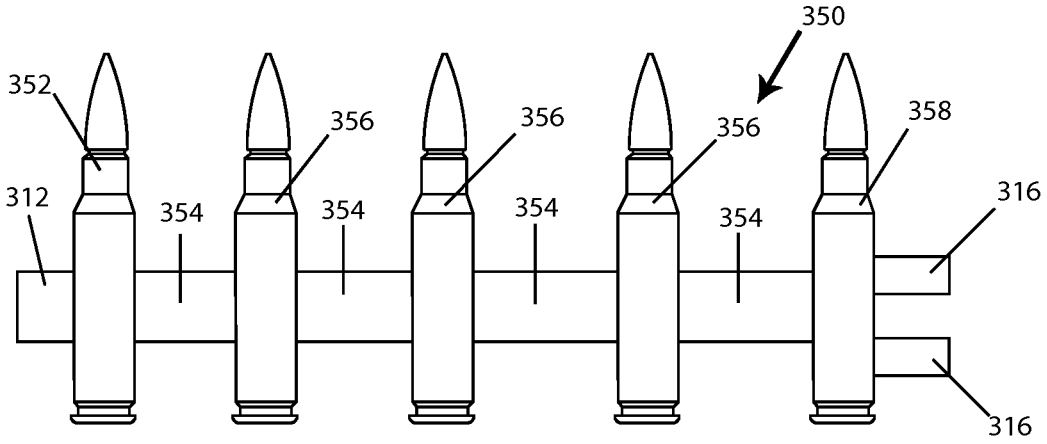
FIG. 5 illustrates an example of formed linked cartridges.
Figure 6A:
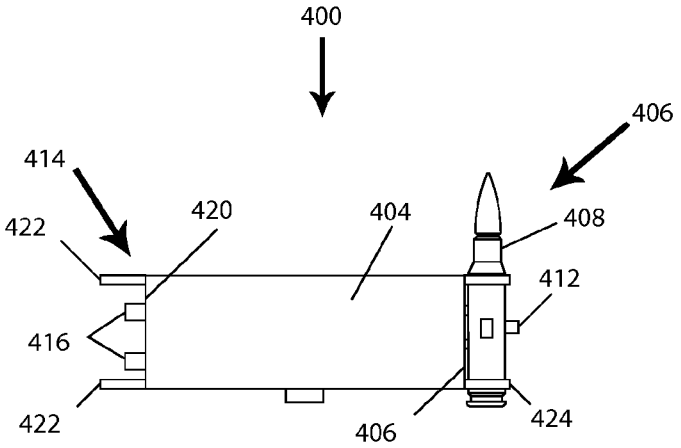
FIGS. 6A-6D illustrate top, left, right, and front views of an example of a fast loading system.
Figure 6B:
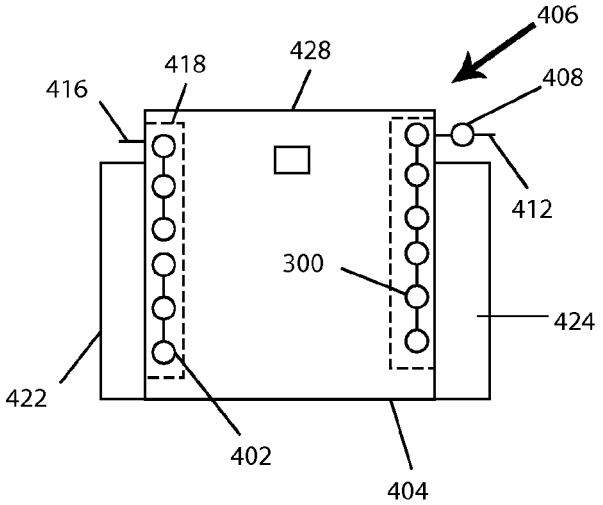
Figure 6C:
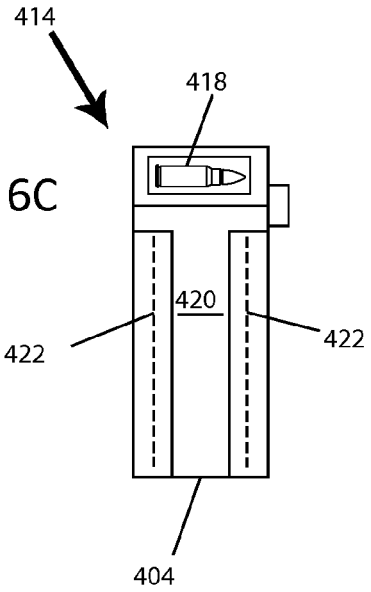
Figure 6D:
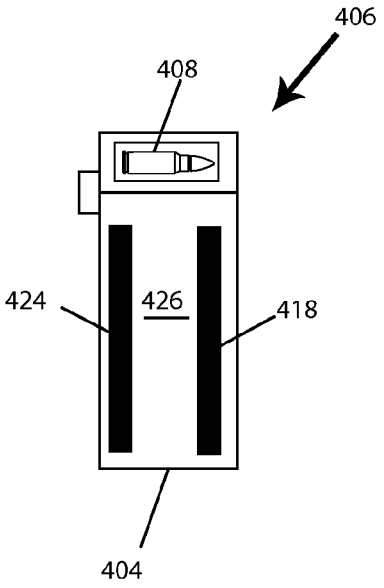

In a further example, the linked cartridges 300 can be molded together in 5 or 10 round groups 350 as illustrated in FIG. 5. In this example, the far left linked cartridge 352 has a single finger 312 formed on one side. On the opposite side is a formed finger 354 joining the linked cartridge 352 to a formed cartridge 356. The formed cartridges 356 are linked together with formed fingers 354 when molded or adhered together. The far right (in this example) linked cartridge 358 can have a formed finger 354 on one side and two fingers 316 on the other. This can allow multiple rounds to be pre-molded, thus requiring less post-molding assembly.

In an example when engaged in the machine gun, the pawl catch 322 on the cartridge 300 is engaged with the pawl described above. As the bolt moves forward to remove the cartridge 300 from the linked belt, it shears the fingers 312, 316 off the body 306 to allow the cartridge to fit in a standard chamber. The fingers 312, 316 are then ejected from the machine gun either separately or through the ejection port for the spent cartridges. To facilitate the shearing process, in one example, the fingers 312, 316 can have a weakened seam 324 where the fingers 312, 316 contact the body 306. The weakened seam 324 can be a thinner polymer than the remainder of the finger or an incomplete adhesion. The weakened seam 324 can withstand travel and manhandling, but can fail completely as the cartridge 300 is loaded into the chamber to prevent jams and misfires. In an alternate embodiment, an existing machine gun may need to be retrofitted with a new bolt or cartridge guides to properly shear the fingers 312, 316.

Note other examples where numerous small fingers can be formed to both the first and second sides 102, 104 creating multiple snap fit points. The only requirement is that the fingers on one side are offset to the other side and the spacing between the fingers allows another finger in between.

Snap-fit linked cartridges 300 can be used in an example of a fast loading system 400, as illustrated in FIGS. 6A-6D. In one example, a 250 round belt 402 of linked cartridges 300 can be packed into fast reloading magazine 404. On a first end 406, or the machine gun end, can be a first load linked cartridge 408. The first load linked cartridge 408 can have a disengaged single finger 412 extending outside a housing 410 of the magazine 404. During shipping and storage, the single finger 412 can be inside the housing 410 or protected in another form, with a removable seal or barrier, from damage. However, once the first load linked cartridge 408 is engaged by a user, there is enough slack in the belt 402 to extract enough of the belt 402 to facilitate loading of the machine gun. In an example, the first number of linked cartridges in the belt 402 can be formed cartridges, as described above.

On the second end 414 can be a reload linked cartridge 418 having two fingers 416. The reload linked cartridge 418 can be at the end of the belt 402 in comparison to the machine gun. In an example, only the two fingers 416 extend past the second end wall 420. On the second end wall 420 can be guide grooves 422 that match and receive rails 424 on a first end wall 426. The grooves 422 and rails 424 can be designed such that when the rails 424 of a second magazine engage the grooves 422 of a first magazine the single finger 412 of the first load linked cartridge 408 aligns with the two fingers 416 of the reload linked cartridge 418 and when the magazines pass, the first load linked cartridge 408 can be linked to the reload linked cartridge 418. This links the two belts and allows for a continuous ammunition supply to the machine gun. There is no need to "reload" to engage the next magazine or belt. The user never has to disengage from the machine gun.

The magazine 402 also can include a lid 428. Once the first magazine is emptied, the lid 428 can be opened, disengaging the first magazine from the belt 402 passing through it from the second magazine, and allowing the first magazine to drop away. The second magazine can then be engaged directly to the machine gun, allowing a third magazine to be engaged in the reload position. Further, if the belt 402 needs to be removed from the housing 410, the lid can be opened to allow access.

In the above examples, any engaging system can be used to align the first load linked cartridge 408 to link it to the reload linked cartridge 418. The grooves and rails can also be switched from one side to the other. The engaging system can run the length of the magazine or portions of it. Further, both the first load linked cartridge 408 and the reload linked cartridge 418 are illustrated at the top of the magazine, but can be in any position and the two do not have to be in the same (mirrored) positions.

Figure 7:
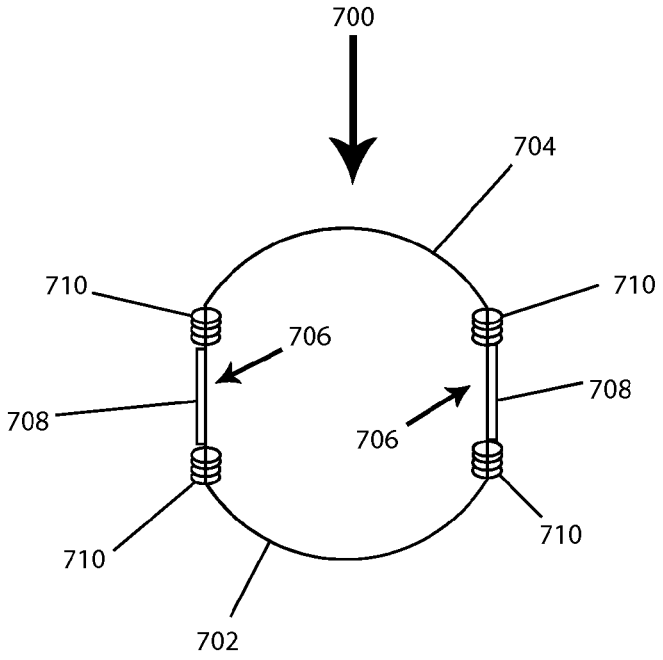
FIG. 7 illustrates an example of a delinking tool.

In another example, users in the field may need to delink one or more linked cartridges 300. FIG. 7 illustrates an example of a delinking tool 700. The tool 700 can include a split housing 702, 704 shaped to pass a linked cartridge 300. An opening 706 between the housings 702, 704 allow the fingers 312, 316, 354 to pass through. Disposed in the openings 706 are cleavers 708. The cleavers 708 are spaced to apply a sharp edge to the fingers 321, 316, 354 and remove them from the body 306 of the cartridge. The cleavers 708 can also engage the weakened seams 324. The tool 700 may expand using elastic elements 710 at the openings so the cartridge can pass completely through and the cleavers 708 do not engage the rim 310. While the example is for one cartridge, multiple tools can be aligned to delink long sections of a belt 402.

Figure 8A:
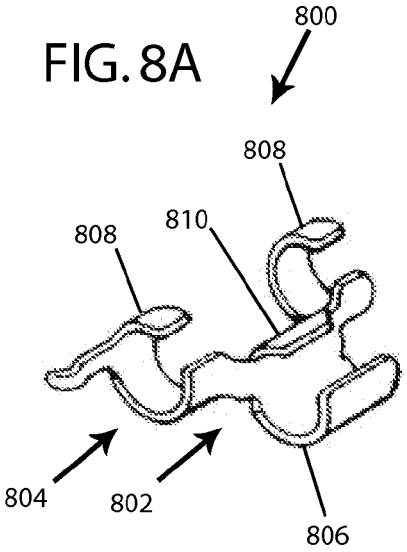
FIG. 8A illustrates a top, front, left isometric view of a skeleton link.
Figure 8B:
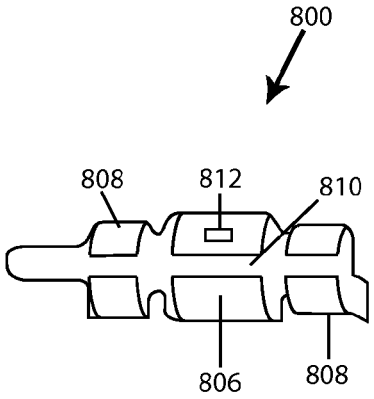
FIG. 8B illustrates a front view of a skeleton link.
Figure 8C:
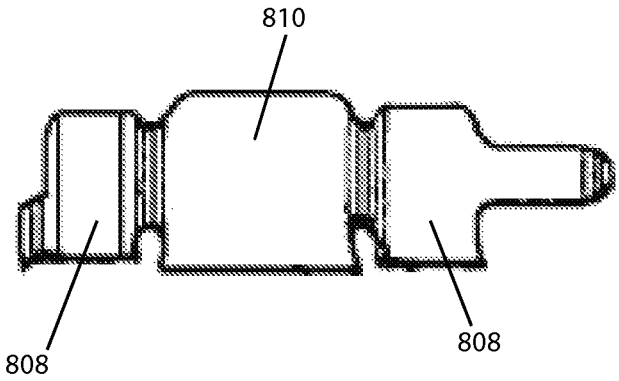
FIG. 8C illustrates a rear view of a skeleton link.

A further example, as illustrated in FIGS. 8A-8C, is a skeleton link 800. The skeleton link 800 can have a first side 802 and a second side 804. The first side 802 can have a single finger 806 to hold a cartridge 200. The second side 804 can have two fingers 808, also to hold a separate single cartridge 200. The two sides 802, 804 are typically joined at a stem 810. The two fingers 808 are typically smaller and spaced along the stem 810 so that the single finger 806 can fit between. The spacing between the two fingers 808 can be dictated by the caliber of the cartridge and the make and model of the machine gun. The single finger 806 can have pawl catch 812 to allow a belt of skeleton links 800 to be pulled through the machine gun as discussed above.

Figure 8D:
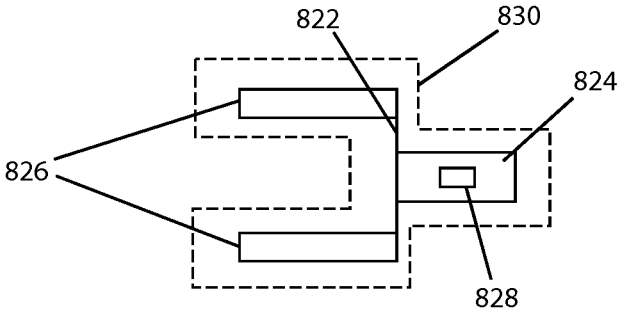
FIG. 8D illustrates a partial cut-away top view of a skeleton link.

The skeleton link 800 can be formed from both metal and polymer. FIG. 8D illustrates a metal skeleton 820. The skeleton 820 can have a short stem 822, shorter and thinner than the entire stem 810. On the opposite sides of the short stem 822 are a small single finger 824 and two small fingers 826. The short stem 822, the small single finger 824 and the two small fingers 826 are such that they are dimensioned smaller in one or all dimensions than the standard dimensions for a link. Further, the skeleton 820 is made of a non-polymer material, typically a metal, metal alloy, or an exotic material, like ceramic.

Since the skeleton 820 is sized smaller than a typical link, in one example, the skeleton 820 alone cannot act as a link to belt link cartridges 200. The skeleton 820 can then be molded with a polymer sheath 830. The polymer sheath 830 covers all or part of the skeleton 820 and can give form, shape, flexibility, and strength to the skeleton link 800. In one example, the small single finger 824 has a raised pawl catch 828 and the polymer sheath does not cover it. In this example, the pawl and pawl catch 828 are a metal-on-metal engagement.

Both the metal for the skeleton 820 and the polymer for the sheath 830 can be the same or different than the metals or polymers used when the link is a uniform material. In the example where the materials are different, each material can play off the strengths and weaknesses of the other. For example, the metal can be less ductile since the flexibility can come from the polymer and the polymer can have a lower strength, relying on the metal for the additional strength.

FIG. 8D illustrates the elements 806, 808, 810 of the skeleton 820 centered in the polymer sheath 830, but in other examples, each element 806, 808, 810 can be located off-center within its polymer section. The skeleton 820 can be placed so that it takes the largest amount of forces or stresses in each location in the link. In one example, the skeleton 820 can take the forces in compression.

Figure 9:
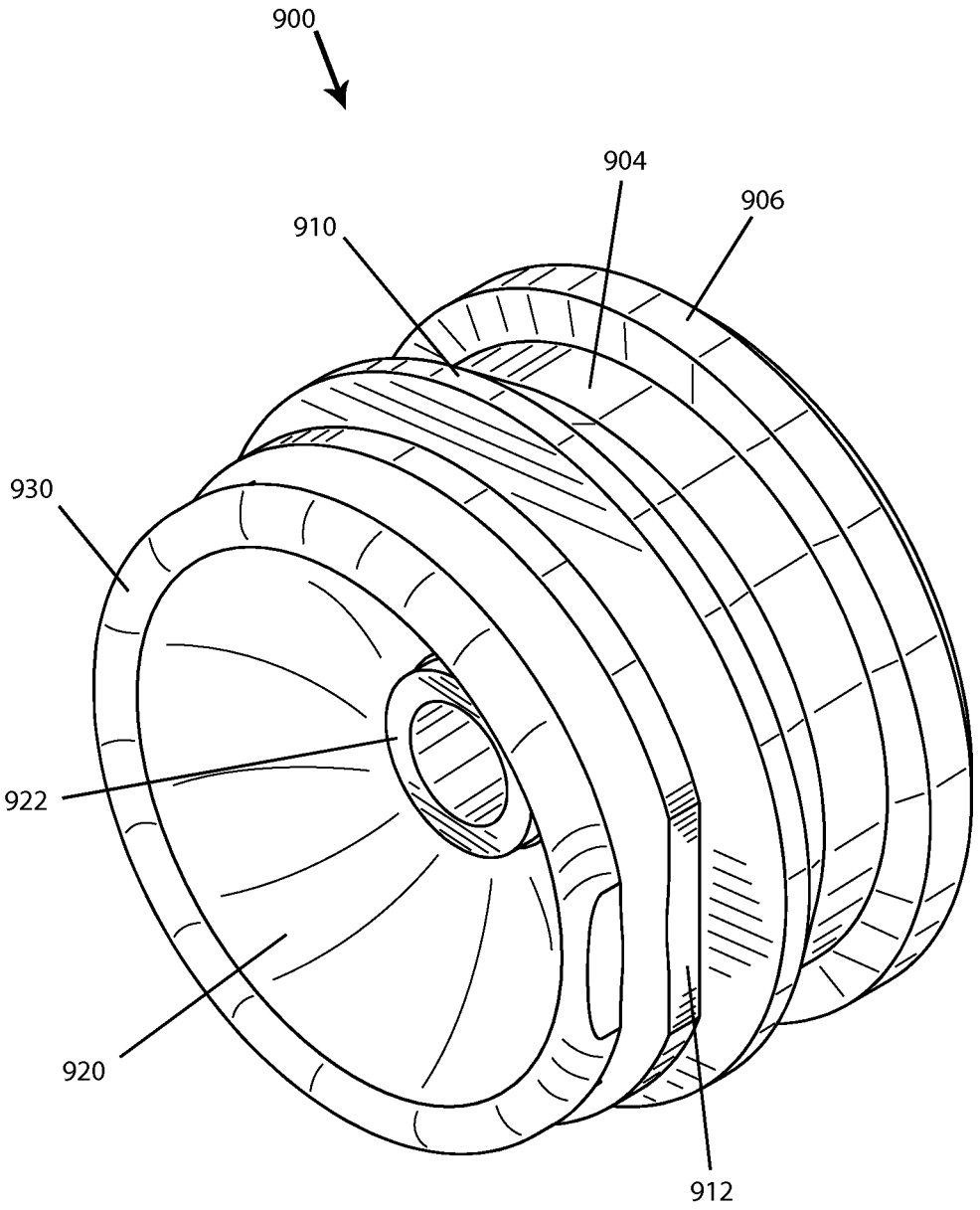
FIG. 9 is a side view of the insert without the upper and lower components.

Turning now to an example of a machine gun insert 900, as illustrated in FIG. 9, it includes an overmolded area 908, where a polymer section of the cartridge 200 engages the insert 900. The overmolded area 908 has one or more ridges 910. The ridges 910 allow the polymer, during molding, to forms bands and the combination of the ridges 910 and bands aid in resisting separation between the insert 900 and the polymer section of the cartridge 200. The resistance is most important during the extraction of the cartridge from the machine gun by the extractor.

The overmolded area 908 also includes one or more keys 912. The keys 912, in one example, are flat surfaces on the ridges 910. These keys 912 prevent the insert 900 from rotating within the cartridge, i.e. the insert 900 twisting around in the lower portion 300. The form of the keys 912 are only an example thereof, and other methods can be used to prevent the relative rotation of the two parts. Other examples can be any surface changes, i.e. dimples, teeth, etc., that perform the same non-rotational function. Below the overmolded area 908, is an extraction groove 904 and a rim 906.

FIG. 11 illustrates an example of the inside of the insert 900. A primer pocket 916 can receive a primer (not illustrated) and, when stricken, causes an explosive force that ignites the powder (not illustrated) in the cartridge. Forward of the primer pocket 916 is a flash hole 918. Again, the flash hole 918 is dimensioned according to the standards for the caliber of the cartridge case and intended use. The flash hole 918 allows the explosive force of the primer, seated in the primer pocket 918, to communicate with the remainder of the cartridge.

Forward of the primer pocket 916 and inside the overmolded area 908 is basin 920. The basin 920 is bowl shaped, wherein the walls curve inwards toward the bottom. The bottom of the basin 920 is interrupted by a ring 922. The ring 922 surrounds the flash hole 918 and extends into the basin 920. The ring 922 can act as a "shutoff" for the mold during the overmolding process. The ring 922 prevents the molten plastic from flowing into the flash hole 918.

At the top of the insert 900 is radiused portion 930. The radiused portion 930 is at the top of the insert 900 inside the overmolded area 908. The radiused portion 930 can be curved to any radius but in one example a small radius is necessary, for example 0.015 mm. The radiused portion 930 can, in one example, distribute stressed caused when the cartridge is ejected from a chamber using an ejector. These stresses are magnified when the cartridge is being fired through a machine gun, which is cycling rounds at a very high rate.

The polymer construction of the cartridge case and links provides a feature of reduced friction which leads to reduced wear on the machine gun, further extending its service life. Further, the polymer lightens the weight of the individual cartridge and the belt.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A high strength polymer-based linked cartridge casing inclosing a volume, comprising:
- a first end having a mouth;
- a neck extending away from the mouth;
- a shoulder extending below the neck and away from the first end;
- a primer pocket disposed at a second end opposite the first end;
- a body extending below the shoulder, comprising:
  - a finger integrally disposed on a first side of the body having a length;
  - at least two fingers integrally disposed on a second side of the body; and
  - a pawl catch integrally disposed on a third side of the body,
  - wherein the at least two fingers are spaced from each other a distance approximately equal to the length, and
  - wherein the at least two fingers are configured to engage a finger disposed on a second cartridge, and
- a flash hole disposed between the first and second end.

2. The high strength polymer-based linked cartridge casing of claim 1, wherein the least two fingers rotatingly engage the finger of the second cartridge.

3. The high strength polymer-based linked cartridge casing of claim 1, wherein at least one of the finger and the at least two fingers are shearable from the body.

* * * * *